United States Patent [19]

Culver et al.

[11] B 3,989,640

[45] Nov. 2, 1976

[54] CORROSION INHIBITOR COMPOSITION

[75] Inventors: Martin J. Culver; Howard R. Stopper, both of Cincinnati, Ohio

[73] Assignee: The Drackett Company, Cincinnati, Ohio

[22] Filed: June 15, 1973

[21] Appl. No.: 370,309

[44] Published under the second Trial Voluntary Protest Program on January 20, 1976 as document No. B 370,309.

[52] U.S. Cl. ..... 252/364; 134/40; 252/8.55 E; 252/171; 252/389 R; 252/392; 260/652.5 R

[51] Int. Cl.[2] ..... C23F 11/14; C23F 11/12; C11D 7/30; C23G 5/02

[58] Field of Search ..... 252/364, 392, 8.55 E, 252/171, 389 R; 260/652.5 R; 134/40

[56] References Cited

UNITED STATES PATENTS

| | | | |
|---|---|---|---|
| 3,113,155 | 12/1963 | Sims | 252/364 |
| 3,546,305 | 12/1970 | Archer | 252/364 |
| 3,609,091 | 9/1971 | Harden et al. | 252/364 |
| 3,676,355 | 7/1972 | Vuillemenot | 252/364 |

FOREIGN PATENTS OR APPLICATIONS

| | | | |
|---|---|---|---|
| 1,546,120 | 7/1971 | Germany | 252/364 |

*Primary Examiner*—Richard D. Lovering
*Assistant Examiner*—Irwin Gluck
*Attorney, Agent, or Firm*—David J. Mugford; George A. Mentis; Samuel J. DuBoff

[57] ABSTRACT

A combination of corrosion inhibitors which act synergistically to prevent corrosion in compositions containing a chlorinated hydrocarbon and a substantially large amount of water.

15 Claims, No Drawings

CORROSION INHIBITOR COMPOSITION

This invention relates to corrosion inhibitors. More particularly, it relates to corrosion inhibitors which prevent decomposition of a chlorinated hydrocarbon in a composition containing a chlorinated hydrocarbon and a substantially large amount of water.

It has long been customary to add corrosion inhibitors to chlorinated hydrocarbon solvents to stabilize them against decomposition, maintain solvency power, and prevent corrosive attack upon metal surfaces by the decomposed solvents. Many stabilizing agents have been proposed as corrosion inhibitors for such chlorinated solvents, but, generally speaking, the effectiveness of a particular inhibitor in a chlorinated solvent system cannot be predicted. As representative of the state of the art, in U.S. Pat. No. 2,970,113, monohydric acetylenic alcohol and 1,4-dioxane were utilized to stabilize 1,1,1-trichloroethane. U.S. Pat. No. 3,070,634 discloses the use of t-butanol, tetrahydrofuran, and 2-methyl-3-butyne-2-ol as a stabilizer composition.

A commercially acceptable corrosion inhibiting additive must also be capable of inhibiting against decomposition of a chlorinated hydrocarbon solvent under hydrolytic conditions. Often the corrosion inhibitor, otherwise acceptable commercially, fails to meet this stringent requirement, and when even a small amount of water is introduced into the system, severe decomposition of the solvent results. In U.S. Pat. No. 3,055,834, solutions of anhydrous anion-active detergents in gases liquified under pressure were utilized in systems containing chlorinated hydrocarbons to combat solvent decomposition and corrosion of the metallic container in the presence of water. In U.S. Pat. No. 3,099,694, a stabilizing mixture of dioxolane a monoolefin and an epoxide compound was introduced into a 1,1,1-trichloroethane system to prevent corrosion under hydrolytic conditions.

Chlorinated hydrocarbon solvents are available commercially containing an inhibitor to protect against decomposition and eventual corrosion of metallic surfaces. However, these inhibitors are only effective in preventing decomposition of chlorinated solvents where water is present in a small amount, and not where the amount of water is substantial or is a desired component of the solvent system. One method of combatting this problem is the addition of a combination of inhibitors to the solvent system, but again, if the amount of water is too high or if water is intended to be a major constituent of the solvent system, then even more than one inhibitor may not prevent decomposition.

An object of the present invention is to provide a corrosion inhibitor composition comprising inhibitors which act synergistically to prevent decomposition of a chlorinated hydrocarbon solvent system wherein water is present in a substantially large amount. Chlorinated hydrocarbon solvents are utilized, for example, in rug cleaning compositions and have advantages over nonsolvent water-based cleaners because the latter are deficient in removal of oil-borne soil due to the lack of solvent action. Thus, another object of the present invention is to incorporate inhibitors, capable of preventing decomposition, in a solvent system wherein the combination of a chlorinated hydrocarbon solvent and water is desirable.

In a preferred embodiment of this invention, an aqueous composition comprises 1,1,1-trichloroethane and water and a three-component corrosion inhibitor composition, present in a minimum concentration of 2.0 percent by weight of the 1,1,1-trichloroethane-water composition and comprising morpholine present in a concentration of 0.5 to 1.33 percent by weight, ammonium benzoate present in a concentration of 0.22 to 0.5 percent by weight, and a member of the group consisting of cyclohexene, nitropropane, and cyclopentene present in a concentration of 0.33 to 1.0 percent by weight, of the 1,1,1-trichloroethane-water composition.

In another preferred embodiment of this invention, an aqueous composition comprises 1,1,1-trichloroethane and water and a three-component corrosion inhibitor composition, present in a minimum concentration of 2.0 percent by weight of the 1,1,1-trichloroethane-water composition and comprising ammonium benzoate present in a concentration of 0.22 to 0.5 percent by weight, butylene oxide present in a concentration of 0.33 to 1.0 percent by weight, and a member of the group consisting of isopropylamine and triethylamine present in a concentration of 0.5 to 1.33 percent by weight, of the 1,1,1-trichloroethane-water composition.

In another preferred embodiment of this invention, an aqueous composition comprises 1,1,1-trichloroethane and water and a three-component corrosion inhibitor composition, present in a minimum concentration of 2.0 percent by weight of the 1,1,1-trichloroethane-water composition and comprising triethylamine present in a concentration of 0.5 to 1.33 percent by weight, sodium benzoate present in a concentration of 0.22 to 0.5 percent by weight, and butylene oxide present in a concentration of 0.33 to 1.0 percent by weight, of the 1,1,1-trichloroethane-water composition.

Some chlorinated hydrocarbon solvents which can be protected against decomposition by the corrosion inhibitor compositions of this invention include: 1,1,1-trichloroethane, trichloroethylene, methylene chloride, and 1,1,2-trichloroethane. This list is not meant to be inclusive or to limit the scope of the invention but merely reflects representative examples, since compositions containing any chlorinated hydrocarbon solvent can be protected. 1,1,1-trichloroethane has been utilized to illustrate the effectiveness of the corrosion inhibitor compositions of this invention since this particular solvent exhibits an aggravated tendency to decompose and concurrently attack metals in comparison to the other chlorinated hydrocarbon solvents which may be utilized.

The effectiveness of the corrosion inhibitor compositions of the present invention is described in the following examples which demonstrate the unique coaction of these inhibitor combinations in stabilizing 1,1,1-trichloroethane to prevent decomposition and corrosion.

EXAMPLE 1

The following solution was prepared and added to a four-ounce bottle:

| Material | Weight % |
|---|---|
| amorphous silica | 10.0 |
| water | 44.0 |
| sodium lauryl sulfate | 1.0 |
| 1,1,1-trichloroethane | 43.0 |

-continued

| Material | Weight % |
|---|---|
| corrosion inhibitor composition | 2.0 |
| | 100.0 |

Steel and tin electrodes, placed opposite each other, were inserted in a rubber stopper to ¼ inch above the bottom of the bottle. The electrodes were firmly pressed together and attached by a clip to give a good electrical connection. These cells were stored at 100°F. for 14 days. At the end of this time, the electrodes were visually observed and the corrosion evaluated.

The corrosion inhibitor compositions, containing a combination of three inhibitors, consisted of one inhibitor from each of the following Groups:

Group I — morpholine, isopropylamine, and triethylamine

Group II — ammonium benzoate and sodium benzoate

Group III — cyclohexene, butylene oxide, cyclopentene, and nitropropane

In this Example, the Group I inhibitor was 0.5 percent by weight, the Group II inhibitor 0.5 percent by weight, and the Group III inhibitor 1.0 percent by weight, of the 1,1,1-trichloroethane-water composition. Evaluation of corrosion was made utilizing the following scale:

CORROSION EVALUATION SCALE

| | |
|---|---|
| Excellent: | Practically no rust, and/or less than 10% of the electrode area detinned. |
| Fair: | No more than 5% of the electrode area rusted, and/or no more than 15% of the electrode area detinned. |
| Poor: | No more than 10% of the electrode area rusted, and/or no more that 20% of the electrode area detinned. |
| Very Poor: | More than 10% of the electrode area rusted, and/or more than 20% of the electrode area detinned. |

Composition 1-1

| Test | INHIBITORS Group I | Group II | Group III | EVALUATION Corrosion Rating |
|---|---|---|---|---|
| A | morpholine | | | Very Poor |
| B | | ammonium benzoate | | Poor |
| C | | | cyclohexene | Very Poor |
| D | morpholine | ammonium benzoate | | Fair |
| E | | ammonium benzoate | cyclohexene | Poor |
| F | morpholine | | cyclohexene | Fair |
| G | morpholine | ammonium benzoate | cyclohexene | Excellent |

The results indicate a reduction in corrosion through the addition of inhibitors from all three Groups (Test G) over the utilization of dual inhibitors (Test D and Test F).

Composition 1-2

| Test | INHIBITORS Group I | Group II | Group III | EVALUATION Corrosion Rating |
|---|---|---|---|---|
| A | morpholine | | | Very Poor |
| B | | ammonium benzoate | | Poor |
| C | | | nitropropane | Very Poor |
| D | morpholine | ammonium benzoate | | Fair |
| E | | ammonium benzoate | nitropropane | Fair |
| F | morpholine | | nitropropane | Very Poor |
| G | morpholine | ammonium benzoate | nitropropane | Excellent |

The results indicate a reduction in corrosion through the addition of inhibitors from all three Groups (Test G) over the utilization of dual inhibitors (Test D and Test E).

Composition 1-3

| Test | INHIBITORS Group I | Group II | Group III | EVALUATION Corrosion Rating |
|---|---|---|---|---|
| A | morpholine | | | Very Poor |
| B | | ammonium benzoate | | Poor |
| C | | | cyclopentene | Very Poor |
| D | morpholine | ammonium benzoate | | Fair |
| E | | ammonium benzoate | cyclopentene | Very Poor |
| F | morpholine | | cyclopentene | Very Poor |
| G | morpholine | ammonium benzoate | cyclopentene | Excellent |

The results indicate a reduction in corrosion through the addition of inhibitors from all three Groups (Test G) over the utilization of dual inhibitors (Test D).

Composition 1-4

| Test | INHIBITORS Group I | Group II | Group III | EVALUATION Corrosion Rating |
|---|---|---|---|---|
| A | morpholine | | | Very Poor |
| B | | ammonium benzoate | | Poor |
| C | | | dioxane | Very Poor |
| D | morpholine | ammonium benzoate | | Fair |
| E | | ammonium benzoate | dioxane | Very Poor |
| F | morpholine | | dioxane | Fair |
| G | morpholine | ammonium benzoate | dioxane | Fair |

The results indicate corrosion not to be appreciably affected by utilization of inhibitors from all three Groups (Test G) over the utilization of dual inhibitors (Test D and Test F). It can be concluded that combining these inhibitors has a non-predictable effect on reduction of corrosion.

Composition 1-5

| Test | INHIBITORS Group I | Group II | Group 3 | Evaluation Corrosion Rating |
|---|---|---|---|---|
| A | morpholine | | | Very Poor |

-continued

| Composition 1-5 | | | | |
|---|---|---|---|---|
| | INHIBITORS | | | Evaluation |
| Test | Group I | Group II | Group 3 | Corrosion Rating |
| B | | ethyl p-amino benzoate | | Fair |
| C | | | butylene oxide | Very Poor |
| D | morpholine | ethyl p-amino benzoate | | Poor |
| E | | ethyl p-amino benzoate | butylene oxide | Fair |
| F | morpholine | | butylene oxide | Very Poor |
| G | morpholine | ethyl p-amino benzoate | butylene oxide | Very Poor |

The results indicate a reduction in corrosion through the utilization of dual inhibitors (Test E) or a single inhibitor (Test B) over the utilization of inhibitors from all three Groups (Test G). It can be concluded that combining these inhibitors has a non-predictable effect on reduction of corrosion.

| Composition 1-6 | | | | |
|---|---|---|---|---|
| | INHIBITORS | | | EVALUATION |
| Test | Group I | Group II | Group III | Corrosion Rating |
| A | morpholine | | | Very Poor |
| B | | benzyl benzoate | | Poor |
| C | | | butylene oxide | Very Poor |
| D | morpholine | benzyl benzoate | | Very Poor |
| E | | benzyl benzoate | butylene oxide | Very Poor |
| F | morpholine | | butylene oxide | Very Poor |
| G | morpholine | benzyl benzoate | butylene oxide | Very Poor |

The results indicate a reduction in corrosion through the utilization of a single inhibitor (Test B) over the utilization of inhibitors from all three Groups (Test G). It can be concluded that combining these inhibitors has a non-predictable effect on reduction of corrosion.

| Composition 1-7 | | | | |
|---|---|---|---|---|
| | INHIBITORS | | | EVALUATION |
| Test | Group I | Group II | Group III | Corrosion Rating |
| A | triethyl-amine | | | Very Poor |
| B | | ammonium benzoate | | Poor |
| C | | | butylene oxide | Very Poor |
| D | triethyl-amine | ammonium benzoate | | Fair |
| E | | ammonium benzoate | butylene oxide | Very Poor |
| F | triethyl-amine | | butylene oxide | Poor |
| G | triethyl-amine | ammonium benzoate | butylene oxide | Excellent |

The results indicate a reduction in corrosion through the addition of inhibitors from all three Groups (Test G) over the utilization of dual inhibitors (Test D).

| Composition 1-8 | | | | |
|---|---|---|---|---|
| | INHIBITORS | | | EVALUATION |
| Test | Group I | Group II | Group III | Corrosion Rating |
| A | triethyl-amine | | | Very Poor |
| B | | sodium benzoate | | Very Poor |
| C | | | butylene oxide | Very Poor |
| D | triethyl-amine | sodium benzoate | | Fair |
| E | | sodium benzoate | butylene oxide | Very Poor |
| F | triethyl-amine | | butylene oxide | Poor |
| G | triethyl-amine | sodium benzoate | butylene oxide | Excellent |

The results indicate a reduction in corrosion through the addition of inhibitors from all three Groups (Test G) over the utilization of dual inhibitors (Test D).

| Composition 1-9 | | | | |
|---|---|---|---|---|
| | INHIBITORS | | | EVALUATION |
| Test | Group I | Group II | Group III | Corrosion Rating |
| A | isopropyl-amine | | | Very Poor |
| B | | ammonium benzoate | | Poor |
| C | | | butylene oxide | Very Poor |
| D | isopropyl-amine | ammonium benzoate | | Poor |
| E | | ammonium benzoate | butylene oxide | Very Poor |
| F | isopropyl-amine | | butylene oxide | Very Poor |
| G | isopropyl-amine | ammonium benzoate | butylene oxide | Excellent |

The results indicate a reduction in corrosion through the addition of inhibitors from all three Groups (Test G) over the utilization of dual inhibitors (Test D) or a single inhibitor (Test B).

The test results of Compositions 1-1 to 1-9 indicate that a composition of inhibitors, one from each of the three Groups stated above, acts synergistically to give improved resistance to corrosion. Compositions 1-1 to 1-3 and 1-7 to 1-9 show single inhibitors (Tests A-C) and even combinations of dual inhibitors from different Groups (Tests D-F), not giving improved resistance to corrosion. Using Composition 1-9, for example, it is shown that utilizing dual inhibitors (Tests D-F) gives no better results than utilizing a single inhibitor (Tests A-C) and only the combination of inhibitors from all three Groups produces a composition with excellent resistance to corrosion. Also, as previously stated, it is shown that the resistance to corrosion when utilizing specific inhibitors from each Group in combination, cannot be predicted. In Compositions 1-4 to 1-6, using morpholine, ammonium benzoate, and dioxane; morpholine, ethyl p-amino benzoate, and butylene oxide; and morpholine, benzyl benzoate, and butylene oxide, no synergism or coaction between inhibitors is shown to prevent decomposition and reduce corrosion. In fact, for Composition 1-5 it is shown that the combination of inhibitors from all three Groups (Test G) gives much less resistance to corrosion than the inhibitor combination of dual inhibitors (Test E) or even a single inhibitor (Test B).

In the preferred embodiments of the present invention, decomposition and corrosion in a 1,1,1-trichloroethane-water composition was reduced through the use of the following corrosion inhibitor compositions:

Composition 1-1 — morpholine, ammonium benzoate, cyclohexane;

Composition 1-2 — morpholine, ammonium benzoate, nitropropane;

Composition 1-3 — morpholine, ammonium benzoate, cyclopentene;

Composition 1-7 — triethylamine, ammonium benzoate, butylene oxide;

Composition 1-8 — triethylamine, sodium benzoate, butylene oxide;

Composition 1-9 — isopropylamine, ammonium benzoate, butylene oxide.

EXAMPLE 2

Utilizing the same test conditions as in Example 1, tests were conducted to determine the effect on resistance to decomposition and corrosion when the corrosion inhibitor concentration is varied. In Example 1, the corrosion inhibitor composition was 2 percent by weight of the 1,1,1-trichloroethane-water composition. In this Example, tests were conducted on Composition 2-2 where the corrosion inhibitor composition was 1 percent by weight, 2 percent by weight, 4 percent by weight, and 8 percent by weight of the 1,1,1-trichloroethane-water composition.

| Composition 2–2 | | | | |
|---|---|---|---|---|
| INHIBITORS | | | | EVALUATION |
| Total Inhibitor % | Morpholine | Ammonium Benzoate | Nitropropane | Corrosion Rating |
| 1% | .25 | .25 | .50 | Poor |
| 2% | .50 | .50 | 1.00 | Excellent |
| 4% | 1.00 | 1.00 | 2.00 | Excellent |
| 8% | 2.00 | 2.00 | 4.00 | Excellent |

These test results indicate the synergistic coaction of the inhibitors and subsequent reduction in corrosion above the 2 percent mimimum concentration. Also, the maximum concentration of corrosion inhibitor composition appears to be dictated only by the economics and dilution of the system.

EXAMPLE 3

Utilizing the same test conditions as in Examples 1 and 2 where the relative ratio of inhibitors from Groups I, II, and III was 1:1:2, Composition 3-2 was tested to determine the effect on resistance to decomposition and corrosion when the relative ratio of inhibitors is varied.

| Composition 3–2 | | | | |
|---|---|---|---|---|
| INHIBITORS | | | | EVALUATION |
| Ratio of Inhibitors | Morpholine | Ammonium Benzoate | Nitropropane | Corrosion Rating |
| 4:1:1 | 1.33% | 0.33% | 0.33% | Excellent |
| 1:1:4 | 0.33% | 0.33% | 1.33% | Fair |
| 1:4:1 | 0.33% | 1.33% | 0.33% | Poor |
| 4:4:1 | 0.89% | 0.89% | 0.22% | Fair |
| 1:4:4 | 0.22% | 0.89% | 0.89% | Poor |
| 4:1:4 | 0.89% | 0.22% | 0.89% | Fair |

These test results indicate that the Group I inhibitor may be in a concentration ratio of 4:1 to either the Group II or Group III inhibitors without effecting resistance to decomposition and corrosion of the 1,1,1-trichloroethane-water composition.

It will be understood that certain minor modifications can be made in the above compositions and methods of testing without departing from the spirit and scope of the invention. While the invention has been described by reference to particular details of certain embodiments, it is not intended to limit the invention to such details except insofar as they appear in the claims.

What is claimed is:

1. A three component corrosion inhibitor composition consisting essentially of morpholine, ammonium benzoate, and a member of the group consisting of cyclohexane, nitropropane, and cyclopentene, wherein the weight ratio of morpholine to ammonium benzoate to said member is 1:1:2 or 4:1:1.

2. A three component corrosion inhibitor composition consisting essentially of ammonium benzoate, butylene oxide, and a member of the group consisting of isopropylamine and triethylamine, wherein the weight ratio of ammonium benzoate to butylene oxide to said member is 1:2:1 or 1:1:4.

3. A three component corrosion inhibitor composition consisting essentially of triethylamine, sodium benzoate, and butylene oxide, wherein the weight ratio of triethylamine to sodium benzoate to butylene oxide is 1:1:2 or 4:1:1.

4. An aqueous composition consisting essentially of a chlorinated hydrocarbon solvent, water present in greater than trace amounts, and at least 2 weight percent based upon the weight of said solvent-water composition of a three component corrosion inhibitor composition consisting essentially of morpholine, ammonium benzoate, and a member selected from the group consisting of cyclohexene, nitropropane, and cyclopentene, wherein the weight ratio of morpholine to ammonium benzoate to said member is 1:1:2 or 4:1:1.

5. A composition according to claim 4 wherein said chlorinated hydrocarbon solvent is 1,1,1-trichloroethane.

6. A composition according to claim 4 wherein morpholine is present in a concentration of 0.5 to 1.33 percent by weight, ammonium benzoate is present in a concentration of 0.22 to 0.5 percent by weight, and said member is present in a concentration of 0.33 to 1.0 percent by weight, of said solvent-water composition.

7. A composition according to claim 5 wherein morpholine is present in a concentration of 0.5 percent by weight, ammonium benzoate is present in a concentration of 0.5 percent by weight, and said member is present in a concentration of 1.0 percent by weight, of said 1,1,1-trichloroethane-water composition.

8. An aqueous composition consisting essentially of a chlorinated hydrocarbon solvent, water present in greater than trace amounts, and at least 2 weight percent based upon the weight of said solvent-water composition of a three component corrosion inhibitor composition consisting essentially of ammonium benzoate, butylene oxide, and a member selected from the group consisting of isopropylamine and triethylamine, wherein the weight ratio of ammonium benzoate to butylene oxide to said member is 1:2:1 or 1:1:4.

9. A composition according to claim 10 wherein said chlorinated hydrocarbon solvent is 1,1,1-trichloroethane.

10. A composition according to claim 8 wherein ammonium benzoate is present in a concentration of 0.22 to 0.5 percent by weight, butylene oxide is present in a concentration of 0.33 to 1.0 percent by weight, and said member is present in a concentration of 0.5 to 1.33 percent by weight, of said solvent-water composition.

11. A composition according to claim 7 wherein ammonium benzoate is present in a concentration of 0.5 percent by weight, butylene oxide is present in a concentration of 1.0 percent by weight, and said member is present in a concentration of 0.5 percent by weight, of said 1,1,1-trichloroethanewater composition.

12. An aqueous composition consisting essentially of a chlorinated hydrocarbon solvent, water present in greater than trace amounts, and at least 2 weight percent based upon the weight of said solvent-water composition of a three component corrosion inhibitor composition consisting essentially of triethylamine, sodium benzoate, and butylene oxide, wherein the weight ratio of triethylamine to sodium benzoate to butylene oxide is 1:1:2 or 4:1:1.

13. A composition according to claim 12 wherein said chlorinated hydrocarbon solvent is 1,1,1-trichloroethane.

14. A composition according to claim 12 wherein triethylamine is present in a concentration of 0.5 to 1.33 percent by weight, sodium benzoate is present in a concentration of 0.22 to 0.5 percent by weight, and butylene oxide is present in a concentration of 0.33 to 1.0 percent by weight, of said solvent-water composition.

15. A composition according to claim 13 wherein triethylamine is present in a concentration of 0.5 percent by weight, sodium benzoate is present in a concentration of 0.5 percent by weight, and butylene oxide is present in a concentration of 1.0 percent by weight, of said 1,1,1-trichloroethane-water composition.

* * * * *